US006088459A

United States Patent [19]

Hobelsberger

[11] Patent Number: 6,088,459

[45] Date of Patent: Jul. 11, 2000

[54] LOUDSPEAKER SYSTEM WITH SIMULATED BAFFLE FOR IMPROVED BASE REPRODUCTION

[76] Inventor: Maximilian Hans Hobelsberger, Dorfstr., Wuerenlingen, Switzerland, CH-5303

[21] Appl. No.: 08/961,075

[22] Filed: Oct. 30, 1997

[51] Int. Cl.[7] ..... H04R 3/00

[52] U.S. Cl. ..... 381/96; 381/59; 381/89

[58] Field of Search ..... 381/335, 186, 381/351, 89, 96, 59

[56] References Cited

U.S. PATENT DOCUMENTS 5,327,504 7/1994 Hobelsberger ..... 381/96

5,461,676 10/1995 Hobelsberger ..... 381/96

5,629,987 5/1997 Hobelsberger ..... 381/96

5,812,686 9/1998 Hobelsberger ..... 381/96

*Primary Examiner*—Forester W. Isen

*Assistant Examiner*—Brian Tyrone Pendleton

[57] ABSTRACT

The loudspeaker system uses an inner transducer for pressure control in the closed loudspeaker housing to simulate the desired baffle properties. The speed of the membrane of the inner transducer is either proportional to the derivative of the pressure, or proportional to the intergral of pressure changes, or comprises summands proportional to the pressure, to the pressure's derivative and to the pressure's intergral.

14 Claims, 4 Drawing Sheets

LOUDSPEAKER SYSTEM WITH SIMULATED BAFFLE FOR IMPROVED BASE REPRODUCTION

BACKGROUND OF THE INVENTION

1. Field of the Invention

This invention relates to sound reproduction systems with electrodynamic loudspeakers and closed housings. More particularly, the invention relates to a sound reproduction system for improved bass reproduction at housings with small volume.

2. Prior Art

Conventional loudspeaker systems have an inferior bass reproduction if the housings or baffles are small. In small housings air compression forces will build up and hinder the movement of the radiating loudspeaker's membrane. These forces evolve from volume changes in the air inside the housing which are caused by the movement of the loudspeaker's membrane. The membrane compresses or decompresses the air and the resulting forces hinder the movement of the membrane. Being elastic forces they also increase the resonance frequency of the system. To achieve a satisfying bass reproduction large, impractical housings are used, or different kinds of resonant boxes are employed. Often the driving signals are corrected in their frequency characteristic, or the loudspeakers are controlled by servo systems. All these solutions cause distortions or are impractical to use, or show a poor pulse response.

Another known method (Tiefenbrun, U.S. Pat. No. 4,008,374) uses a second loudspeaker incorporated into the housing to simulate a larger volume. However this method just transfers the problems from the outer to the inner loudspeaker. To achieve satisfying results large housings must be used once again. Additionally, problems arise from distortions caused by phase differences between the movements of the membranes.

Price Shelton's invention (Goodman, appl. GB.821 5906) follows Tiefenbrun's principle of using an inner transducer to simulate a larger inner volume. In addition Shelton places a pressure sensor into the inner chamber of the housing to measure pressure changes. The signal produced by the sensor is amplified by an operational amplifier and drives the inner transducer. Max Hobelsberger's invention (U.S. Pat. No. 5,461,676) functions according to the same principles, a transducer and a pressure sensor are placed inside the housing. Additionally Hobelsberger uses the principle of servo control to control the air pressure inside the housing: A controller, together with a closed loop control system, keeps the pressure inside the housing equal to the mean air pressure outside the housing.

Another related invention is Max Hobelsberger's device for simulation of an acoustic impedance (Application U.S. Pat. No. 08/601,240) which is used in a loudspeaker system to eliminate reflections and resonances.

SUMMARY OF THE INVENTION

It is an object of this invention to provide a novel loudspeaker system with simulated baffle characteristics. This system provides a superior bass reproduction despite of small physical dimensions of the loudspeaker housing.

The invented system follows the function principle, that the air pressure inside the housing is influenced by a control system in a predetermined manner which simulates certain baffle characteristics, e.g. a certain air volume.

The system comprises a housing with a front loudspeaker and an electrodynamic transducer arranged inside the housing. The housing could be either of the closed type, or it could be a vented housing. The inner transducer is built into an inner wall of the housing. The inner transducer is preferably an electrodynamic transducer, however other types of transducers could be used too. Its membrane is driven by a coil which is placed in the magnetic field of the transducer's magnet system. This inner transducer influences with the movement of its membrane the pressure inside the housing. Pressure sensing means, e.g. a pressure sensor, is mounted inside the housing to measure the air pressure inside the housing which is influenced by the movement of the front loudspeaker's membrane. The output signal of the pressure sensing means is conveyed to calculating means which produce further signals. These signals are applied as setpoint values of movement to a controller which controls via a power amplifier the movement, e.g. the speed, of the inner transducer's membrane. The controller forces the membrane to move with momentary values of movement, e.g. with a speed, according to the setpoint values of movement. Based on the pressure values the setpoint values are calculated in such a way that the desired baffle properties are achieved.

For a fuller understanding of the nature of the invention, reference should be made to the following detailed description of the preferred embodiments of the invention, considered together with the accompanying drawings.

DESCRIPTION OF THE PREFERRED EMBODIMENTS

Figure 1:
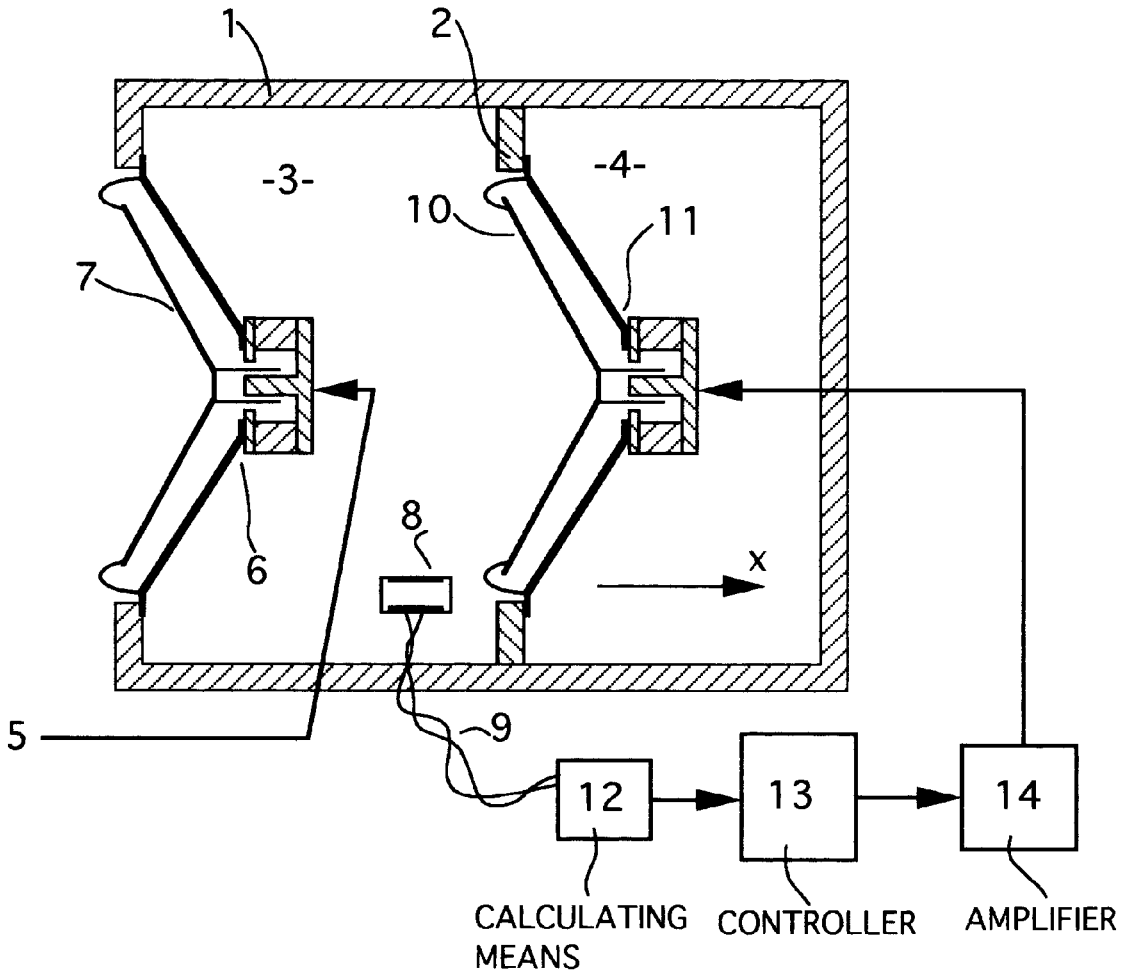
FIG. 1 is a schematic view of a speaker system that is a preferred embodiment of the present invention.

The following is a description of a first embodiment of the invention and refers to FIG. 1.

A loudspeaker 6 is built into an opening of the almost soundproof and pressure-tight housing 1 with its membrane 7 front facing outward. The loudspeaker 6 is directly driven by the audio signal 5. The loudspeaker housing 1 is divided into two chambers, 3, 4, by a soundproof and almost pressure-tight wall 2. "Chamber" means in this context a pneumatically interconnected space within the housing. A chamber could be just a single compartment, or a chamber could consist of a multitude of compartments which are pneumatically connected to each other via openings which allow an easy air flow between each other with low flow resistance. The first chamber, 3, is enclosed by the membrane 7 of the sound radiating loudspeaker 6, by first parts of the walls of the housing and by the inner wall 2. The other chamber, 4, is enclosed by the inner wall 2 and second parts of the walls of the housing 1. An electrodynamic transducer 11 is built into an opening of the inner wall 2 so that its membrane 10 separates the chamber 3 from the chamber 4.

Pressure sensing means 8 is placed in the first chamber 3 which adjoins the membrane 7 of the sound radiating loudspeaker 6. The air pressure in this chamber 3 is measured by the pressure sensing means and a signal s(t) is produced indicative of this pressure. The signal s(t) produced by the pressure sensing means is forwarded via wires 9 to calculating means 12. By the calculating means 12 a calculation is performed using the pressure sensing means output signal s(t) value as input value for the calculation. Based on that input value a momentary output value w(t) is calculated which is forwarded to the controller 13 as setpoint value for the speed. This setpoint value determines how fast the membrane of the inner transducer should move, i.e. its speed. The controller drives via the power amplifier 14 the transducer's membrane 10. The controller is dimensioned to force the membrane to move with a membrane speed v(t) equal to the momentary setpoint value for speed w(t).

The calculating means 12 calculates the output value w(t), i.e. the setpoint value for speed, as being proportional to the timely derivative dp(t)/d(t) of the measured air pressure p(t) in chamber 3.

$$w(t)=K*dp(t)/dt \tag{1}$$

So the resulting speed v(t) of the inner transducer's membrane in outwards direction of chamber 3 (incrementing values on the x-axis) equals the timely derivative of the air pressure in chamber 3 multiplied by a chosen constant K. Constantly increasing pressure will cause a constant speed outwards of chamber 3.

$$v(t)=K*dp(t)/dt \tag{2}$$

With the assumption that the signal s(t) produced by the pressure sensing means is proportional to the air pressure p(t)

$$s(t)=L*p(t) \tag{3}$$

and the assumption that the controller controls the speed according to $$v(t)=A*w(t), \tag{4}$$

where A is the amplification factor of the chain controller—amplifier—inner transducer,
and w(t) is the setpoint value applied to the controller, the calculating means calculate the setpoint value w(t) based on the signal value s(t) according to $$w(t)=(1/A)*(1/L)*K*ds(t)/dt \tag{5}$$

Under these conditions the inner transducer simulates an hypothetical additional inner chamber with a volume V which will be shown by the following equations:
In a chamber with volume $V_i$ the air pressure $p_i(t)$ depends on the additional air mass m(t) flowing into the chamber according to:

$$dp_i(t)/d(t)=B*m(t)/V_i \tag{6}$$

This is under the assumption of an isothermal compression. B is a factor of proportionality. It is further supposed that the hypothetical additional chamber is connected with the main chamber 3 without any pneumatical flow resistance so that $$p_i(t)=p(t). \tag{7}$$

This means that the air mass m(t) flowing into the additional chamber depends on the pressure p(t) according to $$m(t)=(V_i/B)*dp(t)/d(t)=R*dp(t)/d(t) \tag{8}$$

with R being another factor of proportionality.

The movement of the inner transducer's membrane causes such an air mass flow if the controller forces the membrane to move with $$v(t)=K*dp(t)/dt \tag{1}$$

so that the air mass moved by the inner transducer's membrane is $$m(t)=C*F*v(t)=C*F*K*dp(t)/dt \tag{9}$$

with F being the surface of the membrane and C being another factor of proportionality. This is the same behavior as in equation (8), so the transducer behaves like an additional volume.

An integration over time of equation (1) shows that the controller may control the membrane's excursion d(t) instead of the speed v(t) of the membrane to achieve equivalent results, i.e. to control the speed:

$$d(t)=\int v(t)*dt=K(p(t)-p_0) \tag{10}$$

So the excursion d(t) of the membrane, that is the deviation from the membrane's rest position without coil excitation, is proportional to the pressure deviation. This pressure deviation is the difference between the actual pressure p(t) and the mean pressure $p_0$ at rest of the system.

An other solution would be that the controller controls the acceleration a(t) of the membrane according to $$a(t)=K*d^2p(t)/dt^2 \tag{11}$$

According to (11) the acceleration would be proportional to the second derivative of the pressure.

All three solutions are equivalent. The controller can either control directly the speed, or it can control the position of the membrane, or it can control the acceleration of the membrane. Accordingly it will get different kinds of setpoint values. This is valid too for the embodiments described in the following text. The calculating means produce such setpoint values of movement (position, speed or acceleration values) that the controller forces the inner transducer's membrane to move with the desired speed.

In another embodiment of the invention the setpoint values for movement are such that the membrane's speed is not proportional to the timely derivative of pressure but proportional to the timely integral of pressure deviations:

$$v(t)=K*\int(p(t)-p_0(t))*dt \tag{12}$$

This is equivalent to $$dv(t)/dt=K*(p(t)-p_0(t)) \tag{13}$$

According to (13) the acceleration of the membrane of the inner transducer depends on the pressure's deviation from the mean pressure. This is the behavior of a mass with inertia. The inner transducer simulates an additional inner mass. As the loud speaker membrane, its suspension and inner air volume are an oscillating system this simulated additional mass may be used to improve the frequency characteristic of the loudspeaker system.

In a third embodiment of the invention the setpoint values for movement are such that the speed of the membrane is proportional to a sum containing summands which are proportional to the timely derivative of the pressure, to the timely integral of the pressure changes and to the pressure itself:

$$v(t)=U*(K\int p(t)*dt+L*dp(t)/dt+M*p(t)) \tag{14}$$

So the membrane's speed is direct proportional with U to a sum which contains summands, said summands being proportional with K to the timely integral of said air pressure changes, or proportional with L to the timely derivative of said air pressure, or proportional with M to the air pressure itself. This creates even more possibilities to influence the frequency characteristic of the loudspeaker system.

Figure 2:
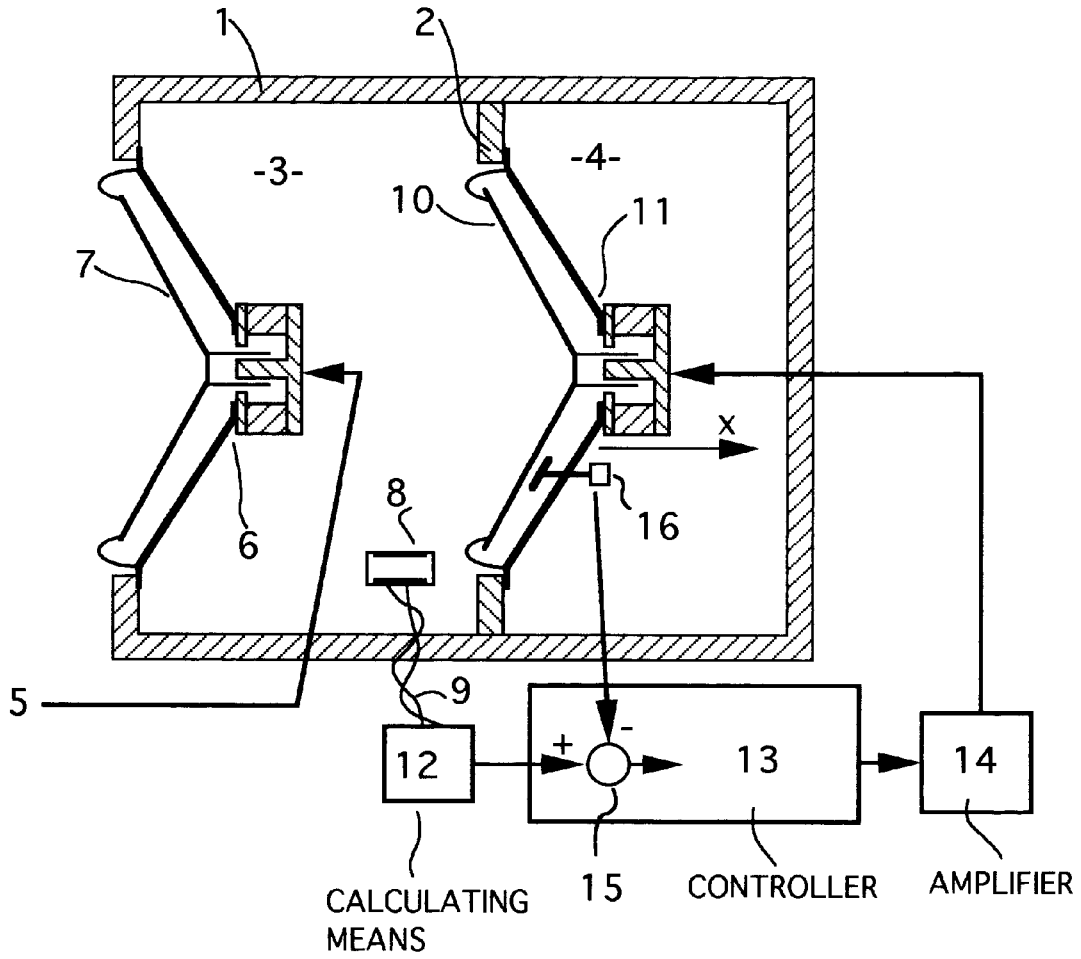
FIG. 2 is a schematic view of a speaker system that is another preferred embodiment of the present invention.

A further embodiment is shown in FIG. 2. It uses a closed loop speed control system for the inner transducer, or, more general a closed loop control system which controls the movement of the inner membrane. It comprises in addition to the above described components measuring means 16 to measure the membrane's momentary values of movement, e.g. a speed sensor or a position sensor. The speed sensor measures the actual speed of the membrane 10. It should be understood that other sensors, e.g. acceleration sensors, can be used too to measure the movement of the membrane. If the acceleration is measured by the sensor the speed value can be gained by integration of the acceleration. The output of the measuring means 16 is connected to the one input of the subtracting means 15. To the other input of the subtracting means the calculated setpoint value for speed is applied. So the actual speed value is subtracted from this calculated speed value which is applied as setpoint value. The resulting signal is further processed by the controller 13 which drives via the power amplifier 14 the transducer's membrane. The controller is dimensioned to hold the membrane's momentary speed equal to the calculated momentary speed setpoint. That means that the membrane's momentary speed depends mainly on the momentary pressure in chamber 2 according to the mathematical functions (1), (10) or (14).

It should be understood that instead of operating just with the speed also other values of the membrane's movement, e.g. acceleration and excursion, can be measured and used by the controller to control the movement of the membrane (state space controller). Generally spoken the controller tries to achieve equality between the setpoint values of movement and the measured momentary values of movement. And the subtracting means could be replaced by other means for comparison.

Figure 3:
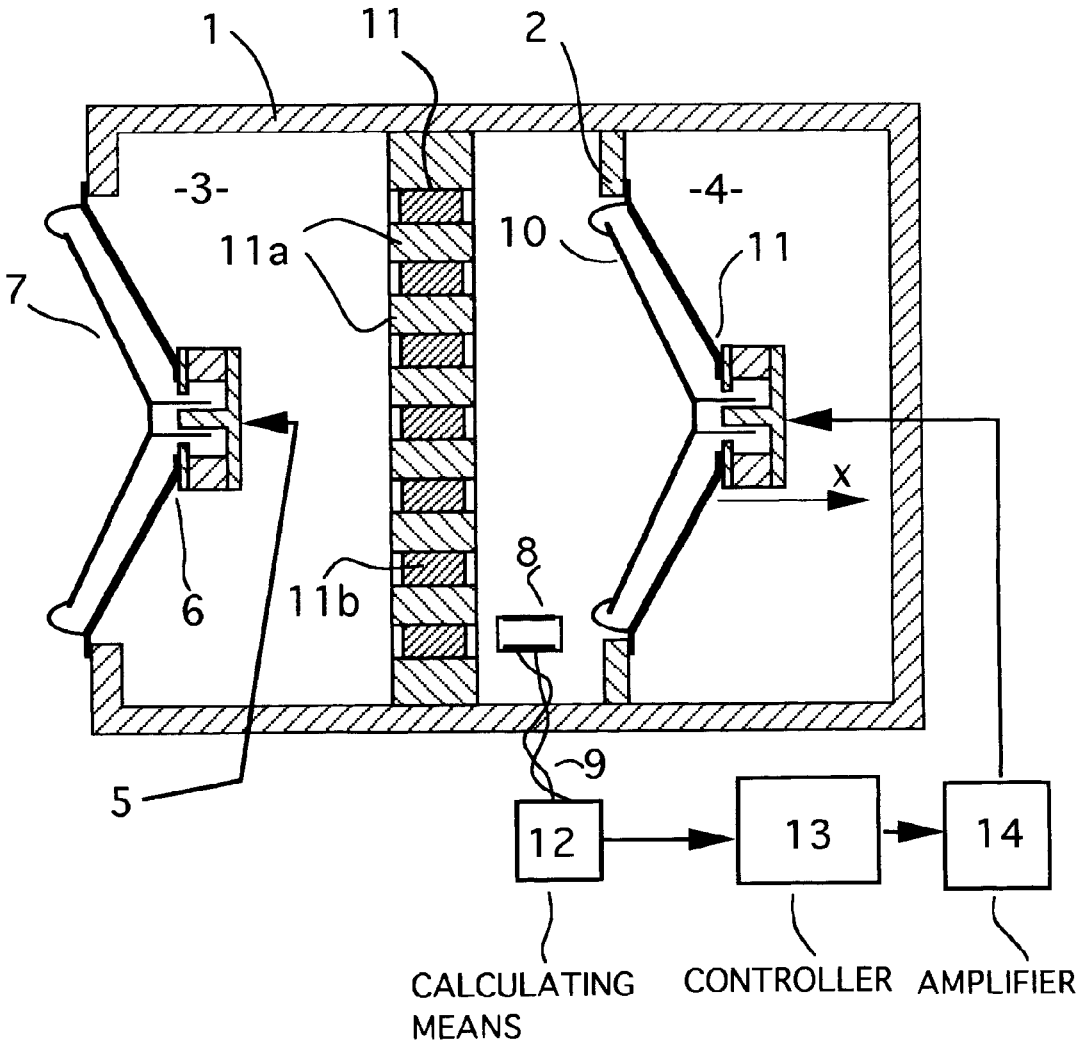
FIG. 3 is a schematic view of a speaker system that is a third embodiment of the present invention.
Figure 4:
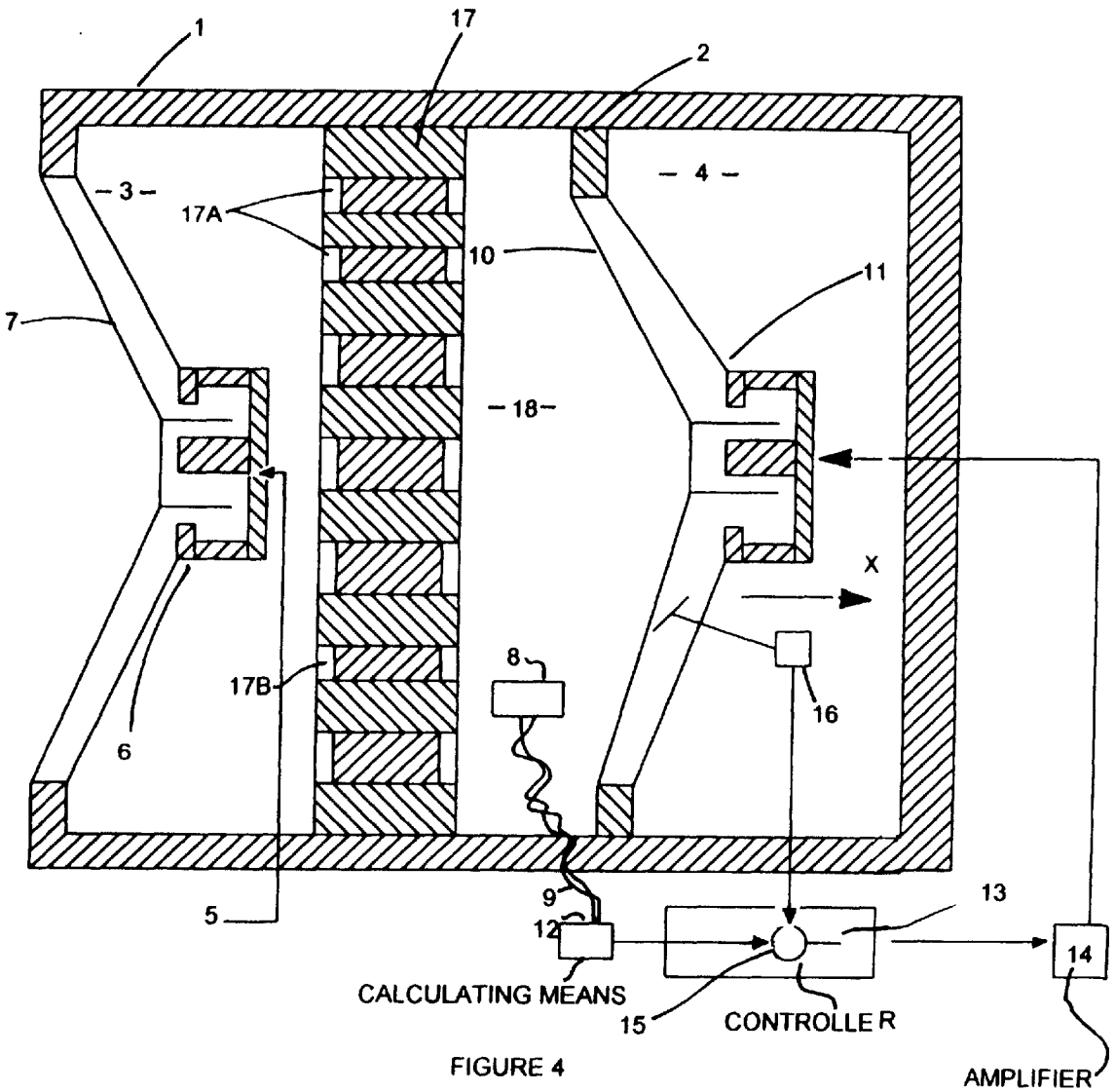
FIG. 4 is a schematic view of a fourth embodiment of the invention.

In a further embodiment of the invention (FIG.3) third wall means 11 are placed between the front loudspeaker and the pressure sensing means. So the inner volume is now divided into three chambers 3, 18, 4. The additional wall means separate the chamber 3 which adjoins to said front loudspeaker's membrane from the chamber 18 where the pressure sensing means are placed. The inner chamber 18 is connected to the first chamber via openings 17*a* in the wall means 17. These openings are shaped and stuffed with sound absorbing material 17*b* in a way, that sound with higher frequencies is absorbed. Sound with lower frequencies can pass this filter. So the pressure sensor is only influenced by the lower frequencies produced by the front loudspeaker the rest of the system is the same as the embodiment of FIG. 1. FIG. 4 shows an embodiment similar to that of FIG. 3. Additionally a speed sensor 16, and substracting means 15 are used in a closed loop system like that of FIG. 2.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. In a loudspeaker system with housing, at which the pressure of the air in the chamber which adjoins the inner surface of the front-loudspeaker's membrane is influenced by the movement of the membrane of an inner transducer built into wall means within the housing, further comprising pressure sensing means arranged within the housing to measure said air pressure, the signals produced by said pressure sensing means being used by calculating means for calculation of setpoint values of movement of said inner transducer's membrane, further comprising a controller and a power amplifier, whereby the controller forces via the power amplifier said inner transducer's membrane to move with values of movement substantially equal to said setpoint values, the improvement comprising said calculating means to produce such setpoint values of movement that said controller forces said inner transducer's membrane to move with a speed which is substantially proportional to a sum which comprises at least two summands selected from the group consisting of a first summand which is proportional to the timely derivative of said air pressure, a second summand which is proportional to the timely integral of the deviation of said air pressure from the mean air pressure, and a third summand which is proportional to said air pressure.

2. Device according to claim 1, wherein said sum contains only said first summand which is proportional to the timely derivative of said air pressure, such that said controller forces said inner transducer's membrane to move with a speed which is substantially proportional to the timely derivative of said air pressure.

3. Device according to claim 1, wherein said sum contains only said second summand which is proportional to the timely integral of the deviation of said air pressure from the mean pressure, such that said controller forces said inner transducer's membrane to move with a speed which is substantially proportional to the timely integral of the deviation of said air pressure from the mean pressure.

4. Device according to claim 1, further comprising measuring means for measuring the momentary values of movement of said transducer's membrane and for producing signals indicative of said momentary values of movement, wherein said measuring means, said controller, said power amplifier and said inner transducer work as closed loop control system for control of the movement of said transducer's membrane, and wherein said controller controls the movement of the membrane of said inner transducer by comparing said setpoint values of movement with said momentary values of movement and by driving the power amplifier with signals according to the results of said comparison in order to achieve substantial equality between said setpoint values of movement and said momentary values of movement.

5. Device according to claim 2, further comprising measuring means for measuring the momentary values of movement of said transducer's membrane and for producing signals indicative of said momentary values of movement, whereby said measuring means, said controller, said power amplifier and said inner transducer work as closed loop control system for control of the movement of said transducer's membrane, whereby said controller controls the movement of the membrane of said inner transducer by comparing said setpoint values of movement with said momentary values of movement and by driving the power amplifier with signals according to the results of said comparison in order to achieve substantial equality between said setpoint values of movement and said momentary values of movement.

6. Device according to claim 3, further comprising measuring means for measuring the momentary values of movement of said transducer's membrane and for producing signals indicative of said momentary values of movement, whereby said measuring means, said controller, said power amplifier and said inner transducer work as closed loop control system for control of the movement of said transducer's membrane, whereby said controller controls the movement of the membrane of said inner transducer by comparing said setpoint values of movement with said momentary values of movement and by driving the power amplifier with signals according to the results of said comparison in order to achieve substantial equality between said setpoint values of movement and said momentary values of movement.

7. Device according to claim 1, wherein between the membrane of said front loudspeaker and said pressure sensing means further wall means are arranged for separating a chamber which adjoins to said front loudspeaker's membrane from a chamber where said pressure sensing means are placed, wherein said wall means are equipped with holes for connecting said chamber where said pressure sensing means are placed, with said chamber which adjoins to said front loudspeaker's membrane, and wherein said holes are so constructed and so stuffed with a fibrous or foamy material, that sound and pressure are transferred through these holes according to a transfer function with substantial low-pass characteristics.

8. Device according to claim 2, wherein between the membrane of said front loudspeaker and said pressure sensing means further wall means are arranged for separating a chamber which adjoins to said front loudspeaker's membrane from a chamber where said pressure sensing means are placed, wherein said wall means are equipped with holes for connecting said chamber where said pressure sensing means are placed, with said chamber which adjoins to said front loudspeaker's membrane, and wherein said holes are so constructed and so stuffed with a fibrous or foamy material, that sound and pressure are transferred through these holes according to a transfer function with substantial low-pass characteristics.

9. Device according to claim 3, wherein between the membrane of said front loudspeaker and said pressure sensing means further wall means are arranged for separating a chamber which adjoins to said front loudspeaker's membrane from a chamber where said pressure sensing means are placed, wherein said wall means are equipped with holes for connecting said chamber where said pressure sensing means are placed, with said chamber which adjoins to said front loudspeaker's membrane, and wherein said holes are so constructed and so stuffed with a fibrous or foamy material, that sound and pressure are transferred through these holes according to a transfer function with substantial low-pass characteristics.

10. Device according to claim 4, wherein between the membrane of said front loudspeaker and said pressure sensing means further wall means are arranged for separating a chamber which adjoins to said front loudspeaker's membrane from a chamber where said pressure sensing means are placed, wherein said wall means are equipped with holes for connecting said chamber where said pressure sensing means are placed, with said chamber which adjoins to said front loudspeaker's membrane, and wherein said holes are so constructed and so stuffed with a fibrous or foamy material, that sound and pressure are transferred through these holes according to a transfer function with substantial low-pass characteristics.

11. Device according to claim 5, wherein between the membrane of said front loudspeaker and said pressure sensing means further wall means are arranged for separating a chamber which adjoins to said front loudspeaker's membrane from a chamber where said pressure sensing means are placed, wherein said wall means are equipped with holes for connecting said chamber where said pressure sensing means are placed, with said chamber which adjoins to said front loudspeaker's membrane, and wherein said holes are so constructed and so stuffed with a fibrous or foamy material, that sound and pressure are transferred through these holes according to a transfer function with substantial low-pass characteristics.

12. Device according to claim 6, wherein between the membrane of said front loudspeaker and said pressure sensing means further wall means are arranged for separating a chamber which adjoins to said front loudspeaker's membrane from a chamber where said pressure sensing means are placed, wherein said wall means are equipped with holes for connecting said chamber where said pressure sensing means are placed, with said chamber which adjoins to said front loudspeaker's membrane, and wherein said holes are so constructed and so stuffed with a fibrous or foamy material, that sound and pressure are transferred through these holes according to a transfer function with substantial low-pass characteristics.

13. Device according to claim 7, wherein between the membrane of said front loudspeaker and said pressure sensing means further wall means are arranged for separating a chamber which adjoins to said front loudspeaker's membrane from a chamber where said pressure sensing means are placed, wherein said wall means are equipped with holes for connecting said chamber where said pressure sensing means are placed, with said chamber which adjoins to said front loudspeaker's membrane, and wherein said holes are so constructed and so stuffed with a fibrous or foamy material, that sound and pressure are transferred through these holes according to a transfer function with substantial low-pass characteristics.

14. Method for improving the bass reproduction of loudspeaker systems with housings, comprising the steps of influencing the pressure of the air in the chamber which adjoins the inner surface of the front-loudspeaker's membrane by moving the membrane of an inner transducer built into wall means within the housing, measuring said air pressure with pressure sensing means arranged within the housing, calculating setpoint values of movement for said inner transducer's membrane using the signals produced by said pressure sensing means, forcing with a controller and a power amplifier said inner transducer's membrane to move with values of movement substantially equal to said setpoint values, and calculating such setpoint values of movement that said controller forces said inner transducer's membrane to move with a speed which is substantially proportional to a sum which comprises at least one summand selected from the group consisting of a first summand which is substantially proportional to the timely derivative of said air pressure, and of a second summand which is substantially proportional to the timely integral of the deviation of said air pressure from the mean air pressure.

* * * * *